United States Patent [19]

Critelli

[11] 4,266,307

[45] May 12, 1981

[54] WATERBED FOUNDATION CONSTRUCTION

[76] Inventor: Frank W. Critelli, 22882 Leo La., El Toro, Calif. 92630

[21] Appl. No.: 878,691

[22] Filed: Feb. 17, 1978

[51] Int. Cl.[2] ..... A47C 27/08

[52] U.S. Cl. ..... 5/451; 5/400; 5/470

[58] Field of Search ..... 5/334 R, 334 C, 365, 5/368–371

[56] References Cited

U.S. PATENT DOCUMENTS

| | | | |
|---|---|---|---|
| 3,702,484 | 11/1972 | Tobinick et al. | 5/451 |
| 3,736,604 | 6/1973 | Carson, Jr. | 5/422 |
| 3,950,800 | 4/1976 | Ganshfield | 5/470 |
| 4,062,073 | 12/1977 | Autrey . | |

*Primary Examiner*—Casmir A. Nunberg
*Attorney, Agent, or Firm*—Victor Sepulveda

[57] ABSTRACT

Herein described is a waterbed and mattress in a single construction form which includes a waterbed bladder placed in a frame and may include an under layer of foam like material and encompasses a top mattress of a foam like or other suitable material. The entire frame may be enclosed within a case or cover and having a zipper entrance therein to accommodate removal, filling and emptying of the water bladder.

6 Claims, 5 Drawing Figures

WATERBED FOUNDATION CONSTRUCTION

BACKGROUND OF THE INVENTION

This invention relates to water filled bladders or mattresses useful in a waterbed and more particularly to a novel and improved liquid filled container used to support a foam like cellular material in the form of an upper pad or mattress.

Since the advent of the waterbed, a number of basic problems have arisen and many attempts to overcome these problems have been tried but until the present invention, the construction of a mattress which is capable of comforting sleep yet is easy to install and to disassemble had not been accomplished.

One of the problems with the prior art waterbed construction is that one could not sit, for example, while dressing or undressing because the weight of the body would displace the water in the water filled bladder to a point where the persons body would virtually go to the bottom of the bladder and rest upon the under frame which would cause discomfort.

Another disadvantage with the present day water bladders and mattresses is that heretofore they had been constructed so that they do not accomodate standard size sheets and linen. They are of such a nature and size that ordinary sheets and linen will not fit and therefore special bedding and linens had to be manufactured. This is done by many manufacturers at an increased cost and passed along to the consumer.

Heretofore prior art waterbed constructions use electrical heaters to keep the water in the water bladder at a constant temperature. Water, for example, will retain cold or heat for relatively long period of time. Thus, if the temperature drops in the night, the water temperature in the water bladder would also drop. When the temperature of the surrounding environment would rise again, the water in the water bladder would still stay at the colder temperature for a relatively longer period, thus providing an uncomfortable sleep for the sleeper. This is especially true during winter months. It then becomes necessary to provide an electric heater which is placed under the waterbed for keeping the water at a constant temperature. Many consumers are fearful of using electrical energy this close to water for fear of electric shock. Further, the use of electrical energy greatly increases one's electric bill and also causes an unnecessary waste of energy.

A further problem encountered in the use of waterbeds is that of puncture of the bladder. It has been found that without any effort whatsoever, a sharp instrument has caused leaks in waterbed bladder to such a point where that even the smallest obstacle is a hazard.

Yet still another problem involved with present day waterbeds is the excessive amount of weight that a waterbed bladder creates on the floor or foundation of the dwelling structure. Thus, in many apartments buildings or houses having upstairs, it is impossible to use a waterbed because the weight thereof is much to heavy for the flooring and foundations of present day homes or apartments.

SUMMARY OF THE INVENTION

The present invention overcomes the difficulty heretofore set forth and provides a waterbed construction comprising a relatively light weight frame which includes a vertical upstanding frame and an inner flat platform support. A somewhat smaller sized water bladder is placed within the vertical frame and on top of the platform support. A cushion may be placed therebetween which may be comprised of a layer of padding, for example, a foam cellulous material. The bladder, the frame and the pad are encased in a cover manufactured from a fabric material which has a zipper thereon so that access may be gained to the water bladder to empty or fill the water bladder or in rare occasions to replace or repair the bladder.

A pad or a mattress is then placed on top of the entire structure and rests upon the bladder.

The entire size and shape of the waterbed frame is the same size and shape as an ordinary box spring or mattress now on sale on the open market. The mattress may also be of any desired size and specifically of the desired size for which ordinary sheets, bedding and linen may be used.

DESCRIPTION OF THE DRAWINGS

These and other features and advantages will become more apparent to those skilled in the art when taken into consideration with the following detailed description of but one preferred embodiment of this invention, wherein like reference numerals indicate like and corresponding parts throughout several views and wherein.

DESCRIPTION OF THE SHOWN EMBODIMENT

Figure 1:
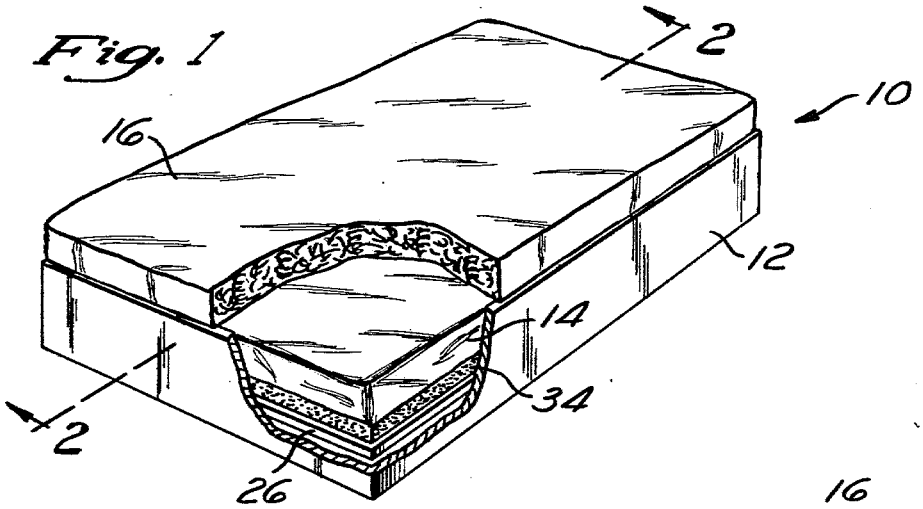
FIG. 1 is a perspective view illustrating the waterbed construction of the present invention showing various cut away portions to better depict the construction of the invention.
Figure 4:
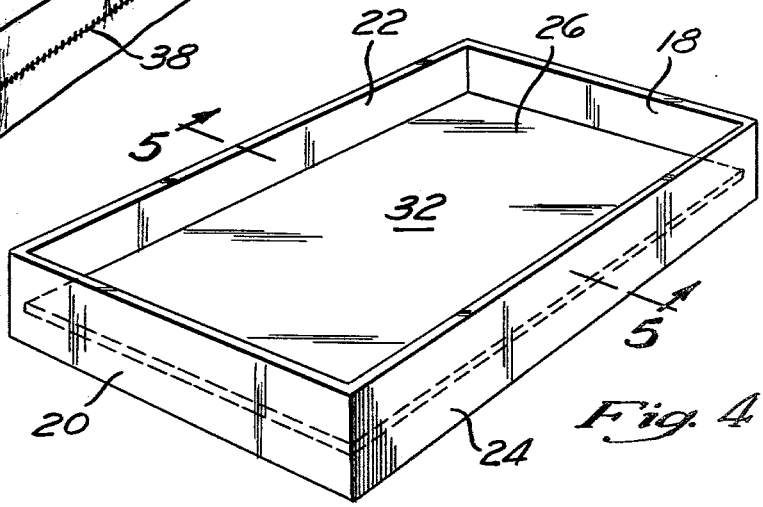
FIG. 4 is a perspective view of the frame which holds the water bladder.
Figure 5:
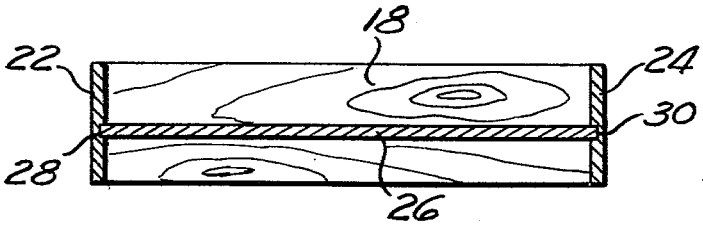
FIG. 5 is a section view taken along the lines 5—5 of FIG. 4.

Turning now to a more detailed description of the shown embodiment there is shown in FIG. 1 and 4 a waterbed construction which includes a frame structure 12. A water bladder 14 which is disposed within the frame 12 and an upper mattress or pad 16 rests upon the bladder 14.

Figure 2:
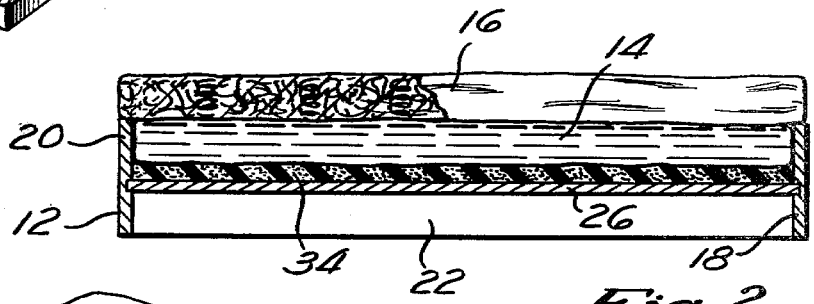
FIG. 2 is a section view taken along the lines 2—2 of FIG. 1 illustrating the inventions construction.

The frame, structure 12, as shown in connection with FIGS. 2 and 4, comprises two vertically disposed end frame members 18 and 20 and two vertically disposed side members 22 and 24. A lateral support platform 26 is disposed within the frame 12. Each end of the side members 22 and 24 are connected to respective end members 18 and 20 and joined together by suitable means to form a rectangular shape. While the present invention shows a rectangular shaped waterbed it should be understood that the construction hereof can be used on any shape of waterbed such as square, oblong and round waterbeds. But for the purpose of this invention, a rectangular waterbed is shown. The platform 26 is secured to the side members 22 and 24 and the end members 18 and 20 in a suitable manner and as shown herein there are securely placed within grooves 28 and 30. This only shows the grooves in the side members 22 and 24 but it should be understood that similar grooves may be provided in the end members 18 and 20 to receive the lateral support platform 26.

Basically the end members 18 and 20, side members 22 and 24 and the lateral support platform are preferrably constructed of a wood material and preferrably the lateral support platform 26 can be constructed of a plywood because of its added strength. The entire height of the frame 12 is in a neighborhood of 7 to 10 inches in height, although not limited thereto, but basically because this is the same height as standard box springs and mattresses now readily available on the market.

Referring to FIG. 2, the water bladder 14 is placed within an inner area 32 and, as shown in FIG. 4, the bladder rests upon the support platform 26. In one preferred embodiment as shown in FIG. 2 an inner pad 34 is provided of a foam like cellulous fiber material, such as sponge or foam rubber, which puts added protection between the wood platform 24 and the water bladder 14 and is used to prevent movement between the water bed bladder 14 and the wood base platform 26 for added comfort for the user.

The mattress 16 may be in the form of an ordinary off the shelf mattress which can be purchased at any retail store or preferably comprised of a foam like cellulous fiber such as a foam rubber pad which allows the user's body to contour with the water in the water bladder 14. The dimensions of the pad 16 is the same dimension as the water bladder 14 yet preferrably will not extend over the edges of the frame 12. Thus the full effect of the water bladder contents can be realized by the sleeper. If a supersoft foam is used as the pad 16, then one's body can easily contour directly with the water.

The basic advantage of the present invention is that the necessity of a heater can be eliminated because of the insulation provided between the user of the waterbed and the water temperature environment is provided by the mattress or pad 16 thereon.

It would be possible now for one to sit on the edge of the bed because the water bladder 16 may be no more than four thick and solid support can be provided thereby.

Also, it can be appreciated that standard sheets, linens and blankets can be used and thus eliminating the necessity of high costs of expensive waterbed sheets.

It can also be appreciated that cotton fiberous material such as those used in European countries for example, make an excellent pad or mattress 16 for the use in the present invention. Also, individually springed mattresses which are now on the market would work extremely well with the present invention.

Because the waterbed bladder 14 is reduced substantially in size, say, for example, four inches in height, the amount of weight, which had heretofore been realized in waterbeds is substantially reduced so that they can be used in an upper floor environment.

Figure 3:
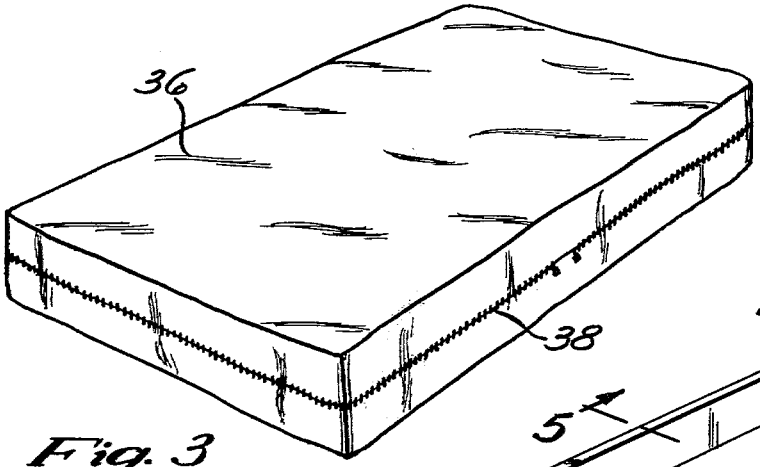
FIG. 3 is a perspective view of the mattress construction encased in a cover.

Referring to FIG. 3, it can be seen that a cover 36 can be used to completely encase the waterbed construction 10, which includes the frame 12 and the water bladder 14. Suitable fastening means such as the zipper 38 is placed around the peripheral edge of the cover 36 so that one might easily gain access into and out of the cover 36 should it be necessary to fill or repair the water bladder 14.

Because of the fact that the waterbed bladder is now completely surrounded by the frame 12 and the upper mattress 16, it is not easily accessible to be punctured or otherwise damaged due to sharp instruments as heretofore the prior art waterbeds.

Having thus described but one preferred embodiment of this invention, what is claimed is:

1. In a waterbed construction:

a frame, said frame including vertically disposed side members and end members joined together to form a substantially rectangular shape, said side members and said end members having an upper edge and a lower edge;

a lateral support platform adapted to be disposed within said side members and said end members and being affixed to said side members and said end members;

a water bladder having a top surface and a bottom surface, said water bladder being comprised of a flexable waterproof material, said water bladder being disposed entirely within said frame and upon said support, said water bladder being adapted to be filled with water to a level so that, the top surface thereof reaches a level substantially to the upper edge of said side member and said end member; and an upper mattress having dimensions so that said mattress rests upon said water bladder.

2. In the water bed construction as defined in claim 1 and further including a cover adapted to be placed around and encase said frame and said bladder.

3. In the waterbed construction as defined in claim 2 and further including means in said cover for gaining access to said water bladder.

4. In the waterbed as defined in claim 1 and further including a pad disposed between said water bladder and said platform.

5. In the waterbed construction as defined in claim 4 and wherein said pad being constructed of a cellulous foam material.

6. In a waterbed construction:

a frame, said frame including a pair of elongated vertically disposed end members joined together to form a substantially rectangular shape, said pair of side members and said pair of end members having an upper edge and a lower edge;

a substantially rectangular shaped lateral support platform disposed within said frame substantively near the lower edge of said pair of side members and said pair of end members, said lateral support being affixed to said pair of side members and said pair of end members and spaced from the lower edge of said pair of side members and said pair of end members a predetermined distance;

a pad constructed of a cellulous foam material disposed upon said lateral support and being substantially rectangular shaped and having dimensions substantially the same as the inside of said frame and of said lateral support;

a water bladder being substantially rectangular shaped and disposed within said frame and upon said pad and supported by said lateral support, said water bladder having a top surface and a bottom surface and being constructed of a flexible waterproof material and being adapted to be filled with water whereby the top surface thereof reaches a level substantially to the upper edge of said pair of side members and said end members of said frame;

a cover adapted to be placed around and completely encase said frame and said bladder;

means disposed in said cover for gaining access to said water bladder; and an upper mattress disposed upon said water bladder being so dimensioned and arranged to rest upon said water bladder and extend to the upper edge of said pair of end members and said pair of side members of said frame.

* * * * *